United States Patent [19]

Yashiki et al.

[11] Patent Number: 4,632,892

[45] Date of Patent: Dec. 30, 1986

[54] PHOTOSENSITIVE MEMBER WITH RESIN HAVING LOW OLIGOMER CONTENT IN CHARGE TRANSPORT LAYER

[75] Inventors: Yuichi Yashiki; Hideki Anayama, both of Yokohama; Masaaki Hiro, Kanagawa, all of Japan

[73] Assignee: Canon Kabushiki Kaisha, Tokyo, Japan

[21] Appl. No.: 663,934

[22] Filed: Oct. 23, 1984

[30] Foreign Application Priority Data

Nov. 1, 1983 [JP] Japan ..... 58-203724

[51] Int. Cl.[4] ..... G03G 5/10

[52] U.S. Cl. ..... 430/58; 430/59

[58] Field of Search ..... 430/58, 59

[56] References Cited

U.S. PATENT DOCUMENTS 3,953,207 4/1976 Horgan ..... 430/58

FOREIGN PATENT DOCUMENTS 1337228 2/1971 United Kingdom ..... 430/58

*Primary Examiner*—John L. Goodrow

*Attorney, Agent, or Firm*—Fitzpatrick, Cella, Harper & Scinto

[57] ABSTRACT

An electrophotographic photosensitive member has at least a charge generation layer and a charge transport layer. The charge transport layer comprises a charge transporting material and a resin which contains at least 95% by weight of components of molecular weight of 500 or higher.

13 Claims, No Drawings

PHOTOSENSITIVE MEMBER WITH RESIN HAVING LOW OLIGOMER CONTENT IN CHARGE TRANSPORT LAYER

BACKGROUND OF THE INVENTION

1. Field of the Invention

The present invention relates to a separate-function type of electrophotographic photosensitive member that has at least a charge generation layer and a charge transport layer. Particularly the invention is directed to an electrophotographic photosensitive member improved in repeated-operational characteristics, in other words, performance characteristics for continuously repeated service.

2. Description of the Prior Art

Practical use of electrophotographic photosensitive layers comprising organic photoconductive material is difficult because it is less sensitive than selenium or cadmium sulfide, but has been realized recently by achieving a high sensitivity with a separate-functional type of photosensitive layer that is a charge generation layer-charge transport layer laminate.

Charge-transporting materials in use for the charge transport layers are, for example, hydrazone compounds as described in U.S. Pat. Nos. 4,150,987 and 4,391,889 and U.K. Patent Application Publication No. 2,034,493, pyrazoline compounds as described in U.S. Pat. No. 3,824,099, and styrylanthracene compounds. Charge transport layers are formed by applying charge-transporting materials dissolved in a resin solution, since charge transporting materials are generally low molecular compounds deficient in film-forming property. Such resins include, for example, polycarbonate, polymethacrylate, polyarylate, polystyrene, polyester, polysulfone, styrene-acrylonitrile copolymer, and styrene-methyl methacrylate copolymer.

Of these resin materials, those radical-polymerized in solution contain large amounts of unreacted monomer, polymerization initiator, etc. even after completion of the polymerization. Polymer components of very low molecular weights like oligomers are also contained in such resin materials. It has been found that, when a charge transport layer is formed by using a resin which contains such non-macromolecular components as mentioned above, these components have unfavorable effects on electrophotographic characteristics of the resulting photosensitive member. According to experiments conducted by the present inventors, the above components tend to cause, in particular, phenomena such as instability of the potential, deterioration of the sensitivity, and increased optical hysteresis, i.e. increase in so-called photomemory, during repeated operations of the photosensitive member.

SUMMARY OF THE INVENTION

Accordingly, an object of the invention is to provide an electrophotographic photosensitive member prevented from the foregoing phenomena, which exhibits stable characteristics.

The above and other objects of the invention are achieved with an electrophotographic photosensitive member comprising at least a charge generation layer and a charge transport layer, characterized in that the charge transport layer is composed of a charge-transporting material and a resin which contains at least 95%, preferably at least 97%, by weight of components having a molecular weight 500 and higher.

DETAILED DESCRIPTION OF EMBODIMENTS OF THE INVENTION

As stated above, the invention is characterized in that the charge transport layer is formed of a resin where the content of components other than high molecular weight components is small.

As the components other than high molecular weight components (non-macromolecular components), non-macromolecular components having molecular weight less than 500, in particular, have proved to exert adverse effects on electrophotographic characteristics of the photosensitive member. Almost all the unreacted monomer, remaining polymerization initiator, and oligomeric fractions are contained in the components of molecular weights less than 500. Since significant adverse effects will be produced in the use of the electrophotographic member if such non-macromolecular components are contained in the resin in an amount of 5% by weight or more, the content of the macromolecular components is at least 95% by weight according to the present invention.

Resins, as mentioned above, used for the formation of charge transport layers contain such non-macromolecular components, i.e. low molecular weight components in significant amounts. Much low molecular weight components are contained specially in such resins radical-polymerized in solution as polymethacrylates [e.g. poly(methyl methacrylate), poly(ethyl methacrylate), poly(butyl methacrylate)], polystyrene, styrene-methacrylate copolymer, styrene-acrylonitrile copolymer, polyesters [e.g. poly(ethylene terephthalate)], etc. In order to use these resins in the invention, such low molecular weight components need to be removed.

Suitable methods for removing the low molecular weight components include (1) proper control of conditions of the polymerization, (2) high temperature treatment of the resin after solvent removal by drying, and (3) deposition of the resin by mixing the resin solution into a poor resin solvent (precipitation method). Method (1) comprises choosing conditions of the polymerization such as the concentration of polymerization initiator and the temperature and period of polymerization, so as to attain a high degree of polymerization, thereby reducing the content of the unpolymerized monomer and other low molecular weight components. Method (2) comprises drying the resin and heating it at a temperature of about 150° to about 200° C. which is below the temperature at which the deterioration of the resin begins, thereby vaporizing the monomer component and other low molecular weight components. Method (3) comprises precipitating the resin in a poor resin solvent to purify the resin. Such poor solvents suitable for the precipitation method include lower alcohols such as methanol and ethanol and aliphatic hydrocarbons such as hexane, heptane, octane, and ligroin. These solvents can not dissolve the resin, but can dissolve the monomer and the polymerization initiator, thus being capable of removing the low molecular weight components. Of the above-mentioned methods, method (3) is most effective for removing the low molecular weight components. Solvents generally used for the polymerization are aromatic hydrocarbons such as toluene, xylene, and chlorobenzene, and ketones and esters.

The resin treated by any of the above methods to secure at least 95% by weight of components of molecular weights 500 or higher is used to form the charge transport layer; however, the treatment for removing the lower molecular weight components in the invention is not limited to the above methods.

In the invention, methyl methacrylate is especially preferred as a monomer component of the resin. Resins containing, as a monomer component, methyl methacrylate (hereinafter these resins are referred to as methyl methacrylic resins) form high strength surfaces hard to flaw or scratch and resistant to abrasion. Solutions of these resins can be prepared to have suitable viscosities and are chemically stable, hence being easy to apply. In addition, these resins have high resistivity and no adverse electrical effect on charge-transporting materials and are good in electrophotographic characteristics.

Although having such advantages, methyl methacrylic resins exhibit no sufficient electrophotographic characteristics when racial-polymerized in solution. Accordingly, these resins need to be treated to secure at least 95% by weight of components of molecular weights 500 or higher. The average molecular weights of these resins are desirably 5000 to 500,000, preferably 10,000 to 200,000.

Charge-transporting materials suitable for use in the invention are hole-transporting materials, for example, a compound having such an aromatic polycyclic ring as anthracene, pyrene, phenanthrene, or coronene in the main chain or as a side chain; a compound having a nitrogen-containing ring such as indole, carbazole, oxazole, isoxazole, thiazole, imidazole, pyrazole, oxadiazole, pyrazoline, thiadiazole, or triazole; and hydrazone compounds.

Hydrazone compounds are specially preferred as charge-transporting materials. Above all, hydrazones represented by the following constitutional formula are best suited. Besides these, pyrazoline compounds are effective.

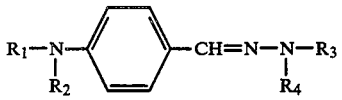

In the formula; $R_1$ and $R_2$ represent each an alkyl such as methyl, ethyl, propyl, butyl, or hexyl; and $R_3$ and $R_4$ represent each an atomic group having such an aromatic ring residue as phenyl, naphthyl, benzyl, or naphthylmethyl which may have a substituent, e.g. methyl, ethyl, propyl, methoxy, ethoxy, or butoxy. While these hydrazone compounds are suited because of excellent electrophotographic characteristics thereof, the charge transporting property thereof tends to be impaired by monomers or polymerization initiators remaining in resins. In consequence, these hydrazones must be combined with said resins that contains at least 95% by weight of components of molecular weights 500 or higher.

Typical examples of the hydrazone compounds and the pyrazoline compounds suited for use in the invention are listed below.

Hydrazone compounds:

-continued

1.

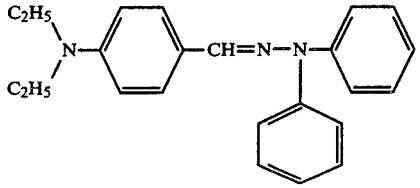

2.

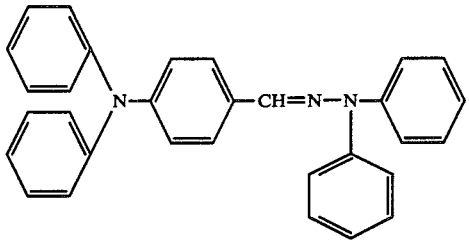

3.

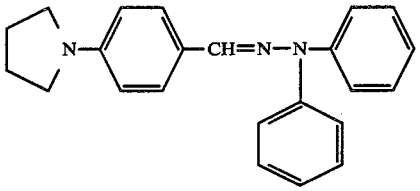

4.

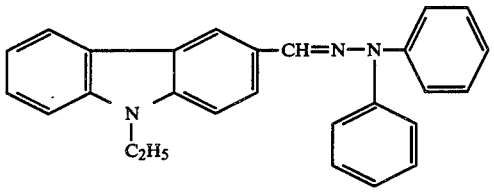

5.

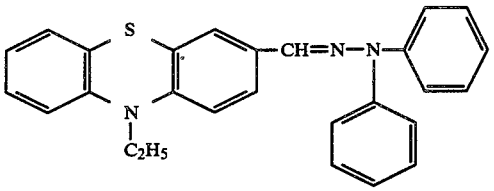

6.

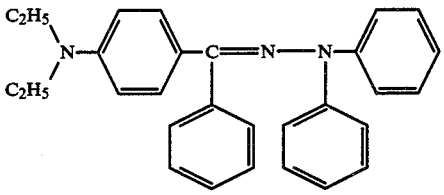

7.

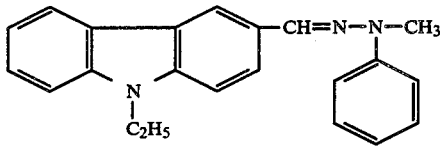

Pyrazoline compounds:

-continued

1.

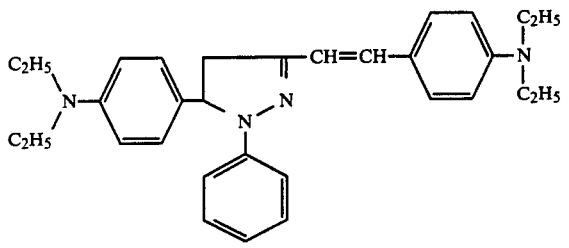

2.

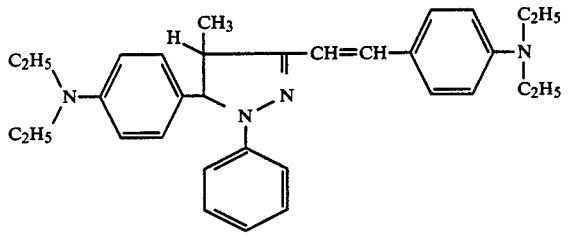

3.

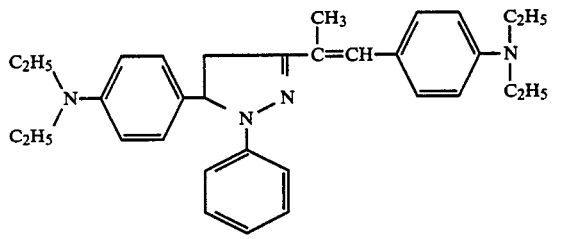

4.

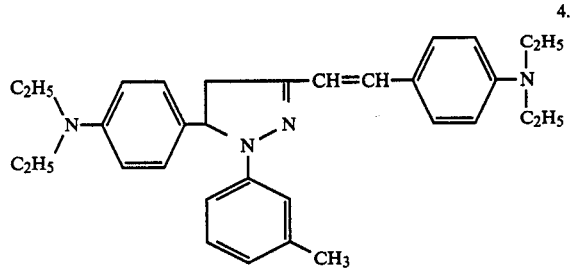

5.

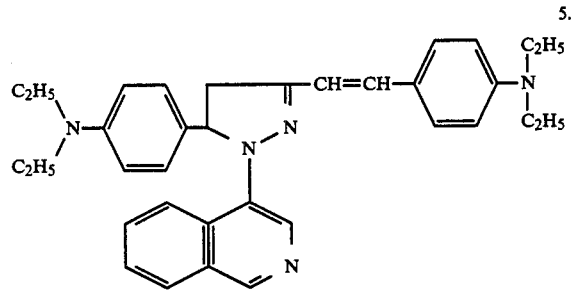

6.

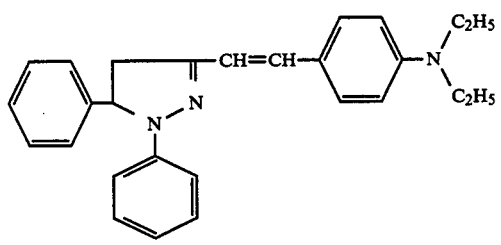

Suitable mixing ratios by weight of the above-mentioned resin to the charge-transporting material are 100:10 to 100:500. The thickness of the charge transport layer is in the range of desirably 2 to 100μ, preferably 5 to 30μ. For the formation of the charge transport layer, there may be used common coating methods such as blade coating Mayer bar coating, spray coating, dip coating, bead coating, air-knife coating, and the like.

Besides the above-mentioned hole-transporting materials, electron-transporting materials can be used as charge-transporting materials. Such electron-transporting materials include electron attractive materials, for example, chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymerization products of these electron attractive materials.

Various organic solvents can be used as a solvent for the formation of the charge transport layer in the invention. Typical examples of the solvent are: aromatic hydrocarbons such as benzene, toluene, xylene, mesitylene, chlorobenzene and the like; ketones such as acetone, 2-butanone and the like; halogenated aliphatic hydrocarbons such as methylene chloride, chloroform, and ethylene chloride; cyclic or linear ether such as tetrahydrofuran and ethyl ether; and mixtures of these solvents.

The charge transport layer of the invention may contain various additives including, for example, diphenyl, o-terphenyl, p-terphenyl, dibutyl phthalate, dimethyl glycol phthalate, dioctyl phthalate, triphenyl phosphate, methylnaphthalene, benzophenone, chlorinated paraffin, dilauryl thiopropionate, 3,5-dinitrosalicylic acid, various fluorocarbons, silicone oil, silicone rubber, and phenolic compounds such as dibutylhydroxytoluene, 2,2'-methylene-bis(6-tert-butyl-4-methylphenol), α-tocopherol, 2-tert-octyl-5-chlorohydroquinone, and 2,5-di-tert-octylhydroquinone.

The charge generation layer of the invention is formed by dispersing a charge-generating material in a solution or dispersion of a resin and applying the resulting dispersion. Suitable charge-generating materials for use herein include; azo pigments, e.g. Sudan Red, Diane Blue and Janus Green B; Quinone pigments, e.g. Algol Yellow, pyrenequinone, and Indanthrene Brilliant Violet RRP; Quinocyanine pigments; perylene pigments; indigo pigments, e.g. indigo and thioindigo; bis benzoimidazole pigments, e.g. Indo Fast Orange Toner; phthalocyanine pigments, e.g. copper phthalocyanine; and quinacridone pigments. Suitable binder resins for use herein include polyester, polystyrene, poly(vinyl butyral), polyvinylpyrrolidone, methyl cellulose, polyacrylates, and cellulose esters. The thickness of the charge generation layer is in the range of desirably 0.01 to 1μ, preferably 0.05 to 0.5μ.

The photosensitive layer comprising the above described charge generation and charge transport layers laminated upon each other is formed upon an electrically conductive substrate. The conductive substrate can be formed of a material having conductivity itself, for example, aluminum, aluminum alloy, copper, zinc, stainless steel, vanadium, molybdenum, chromium, titanium, nickel, indium, gold, or platinum; a plastic layer [e.g. polyethylene, polypropylene, poly(vinyl chloride), poly(ethylene terephthalate), acrylic resin, or polyfluoroethylene layer] overlaid with a conductive film formed by vacuum deposition of aluminum, aluminum alloy, indium oxide, tin oxide, or indium oxide-tin oxide alloy; a plastic layer coated with conductive particles (e.g. carbon black or silver particles) combined with a suitable binder; a plastic layer or paper impregnated with conductive particles; or a plastic layer composed of a conductive polymer.

A subbing layer serving as a barrier and an adhesive can be laid between the conductive layer and the photosensitive layer. This subbing layer can be formed of casein, poly(vinyl alcohol), nitrocellulose, ethylene-acrylic acid copolymer, polyamide (e.g. nylon 6, nylon 66, nylon 610, copolymerized nylon, or alkoxymethylated nylon), polyurethane, gelatin, aluminum oxide or the like. The thickness of the subbing layer is in the range of desirably 0.1 to 5$\mu$, preferably 0.5 to 3$\mu$.

In the operation of the photosensitive member comprising a conductive substrate, charge generation layer, and charge transport layer laminated in that order, the surface of the charge transport layer needs to be given positive charge when the charge transport layer comprises an electron-transporting material. On image exposure of the photosensitive member after charging, electrons produced in the exposed regions of the charge generation layer are injected into the opposing regions of the charge transport layer, then arrive at the surfaces of the regions, and neutralize the positive charge to decay the surface potential, thereby forming an electrostatic contrast between the exposed and unexposed regions. A visible image is obtained by developing the thus formed electrostatic latent image with a negative-charging toner. This toner image can be fixed directly or after transferring onto paper, plastic film, or the like.

It is also possible to transfer the electrostatic latent image formed on the photosensitive member onto the insulation layer of transfer paper and develop the transferred latent image followed by fixing. The developer, developing technique, or fixing technique is not particularly limited, but is free to choose any of those hitherto known.

When the charge transport layer, on the other hand, comprises a hole-transporting material, the surface of the layer needs to be given negative charge. On image exposure after charging, holes produced in the exposed regions of the charge generation layer are injected into the opposing regions of the charge transport layer, then arrive at the surfaces of the regions, and neutralize the negative charge to decay the surface potential, thereby forming an electrostatic contrast between the exposed and unexposed regions. For the development, a positive-charging toner is required to use, contrary to the case with the electron-transporting material.

According to the invention, an electrophotographic photosensitive member having excellent performance characteristics can be provided by using a resin containing at least 95% by weight of high molecular weight components.

The invention is illustrated by way of the following examples. In the examples, molecular weights (average molecular weights) of resins and contents of components of molecular weights of at least 500 in the resins were determined by using a gel permeation chromatographic instrument "Try Rotar SR-2" (employing a Shodex A-80M column) supplied by Japan Spectroscopic Corp.

EXAMPLE 1

Methyl methacrylate (80 g), styrene (45 g), and benzoyl peroxide (2.4 g) as polymerization initiator in toluene (130 g) were placed in a stirrer-equipped flask, and reacted with stirring at 110° C. for 6 hours while passing nitrogen gas through the reaction mixture. Thus a copolymer having an average molecular weight of 50,000 was obtained. Analysis indicated that the resin contained 94 wt. % of components of molecular weights at least 500 and additionally 6 wt. % of components of molecular weights less than 500 including 2 wt. % of the monomer components and 0.5 wt. % of the initiator.

The resin was dried in a 160° C. oven dryer over a period of 8 hours. Analysis indicated that the dried resin contained 97.5 wt. % of components of molecular weights at least 500 and 2.5 wt. % of components of molecular weights less than 500.

The dried resin (40 g) was dissolved in toluene (340 g), and then a hydrazone compound (20 g) represented by the following formula was dissolved additionally.

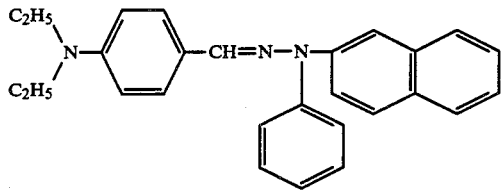

On the other hand, a disazo pigment (10 parts by weight) (hereinafter "parts by weight" is abbreviated as "parts") represented by the formula

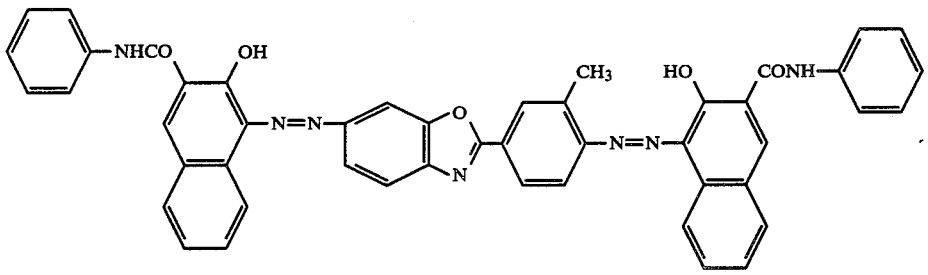

and a cellulose acetate butyrate resin (supplied by Eastman Chemical Products Inc. under the tradename of CAB-381) (6 parts) were sand-milled in cyclohexanone (60 parts) for 20 hours using 1-mm $\phi$ glass beads. The resulting dispersion was mixed with methyl ethyl ketone (100 parts) to prepare a coating material, which was then applied around a casein-subbed aluminum cylinder of 60 mm$\phi$×260 mm. Thus a charge generation layer of 0.07 g/m$^2$ in coating weight was formed.

The above hydrazone solution was applied on this charge generation layer to form a charge transport layer of 15μ thick.

The thus prepared electrophotographic photosensitive member (sample 1) was set in an electrophotographic copying machine having the stages of −5.6 KV corona charging, image exposure, dry toner development, toner image transfer onto plain paper, and cleaning with an urethane rubber (Hardness 70°, pressure 5 gw/cm, angle to the surface of the photosensitive member: 20°), and electrophotographic characteristics thereof were evaluated.

Potential measurements indicated a dark area potential ($V_D$) of −650 V and a light area potential ($V_L$) of −100 V, that is, the contrast was 550 V. Reproduced images were good in quality. Potential measurements after continuous formation of 100 copies, indicated a $V_D$ of −650 V and a $V_L$ of −120 V. Thus slight variations were observed in the potentials and the formed images were similarly good.

For comparison, an electrophotographic photosensitive member (comparative sample 1) was prepared and evaluated by repeating the above procedure but using the polymerized resin without the heat treatment for the formation of the charge transport layer. The $V_D$ was −620 V and the $V_L$ was −150 V, the contrast being −470 V. In consequence, this photosensitive member gave reproduced images inferior in density. After continuous formation of 100 copies, the $V_D$ was −610 V and the $V_L$ was −200 V. Thus the image density was lowered along with the contrast.

In addition, the photomemory was evaluated on the two photosensitive members. The photosensitive member was charged once and the charging characteristic was measured. Then the photosensitive member was irradiated at 500 lux for 3 minutes with a fluorescent lamp, and in one minute after finishing the irradiation, the charging characteristic was measured under the same condition as above. The difference between the surface potentials before and after this irradiation was regarded as a photomemory. Results thereof were as follows:

| Photosensitive Member | Photomemory (V) |
|---|---|
| Sample 1 | |
| The used resin contained 97.5 wt. % of components of molecular weights at least 500 | −20 |
| Comparative sample 1 | |
| The used resin contained 94 wt. % of components of molecular weights at least 500 | −110 |

EXAMPLE 2

An electrophotographic photosensitive member (sample 2) was prepared and evaluated in the same manner as in Example 1 except for using a pyrazoline compound represented by the following formula in place of the hydrazone compound for the formation of the charge transport layer.

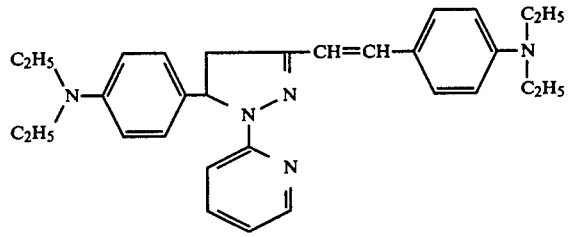

The found $V_D$, $V_L$, and contrast were −650 V, −80 V, and 570 V, respectively, and reproduced images were good. After continuous formation of 100 copies, the found $V_D$, $V_L$, and contrast were −630 V, −120 V, and 510 V, respectively, and the images were also good. With respect to variation in potential contrast, however, the hydrazone compound of Example 1 was advantageous over this pyrazoline compound.

EXAMPLE 3

A mixture of methyl methacrylate (100 g), azobisisobutyronitrile (1.0 g) as polymerization initiator, and toluene (150 g) was placed in a stirrer-equipped flask. The polymerization was initiated at 98° C. with stirring while passing nitrogen gas through the mixture. After 2 hours, azobisisobutyronitrile (0.3 g) was supplied, the polymerization was further continued for 8 hours, and the mixture was cooled to 20° C.

Thus a poly(methyl methacrylate) of average molecular weight 110,000 was obtained. The polymer was found to contain 94.5 wt. % of components of molecular weights of at least 500 and 5.5 wt. % of components of molecular weights less than 500.

The polymer solution was added dropwise to methanol (2 l) with stirring to precipitate the resin, which was then filtered off and thoroughly dried in a stream of hot air at 100° C. The resulting resin was found to contain 99.0 wt. % of components of molecular weights at least 500. Thus the content of components of molecular weights less than 500 was reduced to 1.0 wt. %.

The dried resin (30 g) and the same hydrazone compound (25 g) as used in Example 1 were dissolved in toluene (330 g). This solution was applied on a charge generation layer which had been formed in the same manner as in Example 1, thereby forming a charge transport layer of 15μ thick.

The thus obtained electrophotographic photosensitive member (sample 3), on evaluation of characteristics, showed a $V_D$ of −610 V and a $V_L$ of −110 V and reproduced good images. After continuous formation of 100 copies, the $V_D$ and $V_L$ were −570 V and −120 V, respectively, and no change was observed in reproduced images.

In constrast to this, an electrophotographic photosensitive member (comparative sample 2) prepared by using the above resin without such precipitation treatment showed a $V_D$ of −680 V and a $V_L$ of −200 V.

The $V_L$ was so large that the reproduced images showed fogging on the background, being inferior in quality.

These photosensitive members were further tested for photomemory in the same manner as in Example 1. Results thereof were as follows:

| Photosensitive Member | Photomemory (V) |
|---|---|
| Sample 3 | |
| The used resin contained 99.0 wt. % of components of molecular weights at least 500 | −10 |
| Comparative sample 2 | |
| The used resin contained 94.5 wt. % of components of molecular weights at least 500 | −120 |

EXAMPLE 4

Styrene (100 g) with azobisisobutyronitrile (1.5 g) in toluene (150 g) was placed in a stirrer-equipped flask, and polymerized with stirring at 100° C. for 8 hours while passing nitrogen gas through the mixture. Thus a polystyrene of average molecular weight 100,000 was obtained in solution. The polymer was found to contain 94.0 wt. % of components of molecular weights at least 500 and 6.0 wt. % of components of molecular weights less than 500.

The polymer solution was added dropwise to methanol (3 l) with stirring to precipitate the resin, which was then filtered off and thoroughly dired out at 100° C. The resulting resin was found to contain 99.0 wt. % of components of molecular weights at least 500.

This polystyrene (30 g) and a hydrazone compound (23 g) representd by the formula

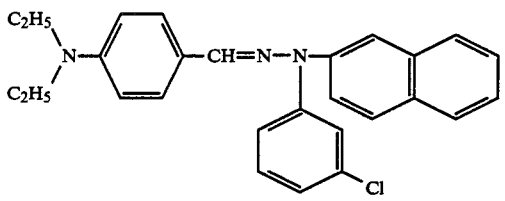

were dissolved in toluene (280 g). This solution was applied on a charge generation which had been formed in the same manner as in Example 1, thereby forming a charge transport layer 15μ thick.

The thus obtained electrophotographic pohtosensitive member (sample 4), on evaluation of characteristics, showed a $V_D$ of −620 V and a $V_L$ of −110 V and reproduced good images. After continuous formation of 100 copies, the $V_D$ and $V_L$ were −590 V and −120 V, respectively, and no change was observed in reproduced images.

In contrast to this, an electrophotographic photosensitive member (comparative sample 3) prepared by using the above resin without such precipitation treatment showed a $V_D$ of −680 V and a $V_L$ of −220 V. The $V_L$ was so large that the reproduced images showed fogging on the background, being inferior in quality.

These photosensitive members were further tested for photomemory in the same manner as in Example 1. Results thereof were as follows:

| Photosensitive member | Photomemory (V) |
|---|---|
| Sample 4 | |
| The used resin contained 99.0 wt % of components of molecular weights at least 500 | −20 |
| Comparative sample 3 | |
| The used resin contained 94.0 wt % of components of molecular weights at least 500 | −130 |

EXAMPLE 5

A linear polyester resin produced from terephthalic acid and ethylene glycol was employed. This resin, having an average molecular weight of about 38,000, was found to contain 6.0 wt % of components of molecular weights less than 500. After drying in a vacuum dryer at 180° C. over 10 hours, the resin was found to contain 99.0 wt % of components of molecular weights at least 500 and 1.0 wt % of components of molecular weights less than 500.

The vacuum-dried resin (30 g) and the same hydrazone compound (20 g) as used in Example 4 were dissolved in a mixture of methyl ethyl ketone (100 g) and toluene (150 g). The solution was applied on a charge generation layer formed in the same manner as in Example 1, thereby forming a charge transport layer of 14μ thick.

The thus obtained electrophotographic photosensitive member (sample 5) showed a $V_D$ of −630 V and a $V_L$ of −100 V (contrast 530 V) and reproduced good images. After continuous formation of 100 copies, the $V_D$ and $V_L$ were −620 V and −120 V, respectively, and the variation was a little, and the reproduced images were good.

In contrast to this, an electrophotographic photosensitive member (comparative sample 4) prepared by using the above resin without such vacuum drying as stated above showed a $V_D$ of −600 V and a $V_L$ of −150 V. Thus the contrast was as small as 450 V and reproduced images were poor in density. After continuous formation of 100 copies, the $V_D$ and $V_L$ were −580 V and −200 V, respectively, and reproduced images were further inferior in quality.

Results of photomemory tests conducted on these photosensitive members in the same manner as in Example 1 were as follows:

| Photosensitive member | Photomemory (V) |
|---|---|
| Sample 5 | |
| The used resin contained 99.0 wt % of components of molecular weights at least 500 | −10 |
| Comparative sample 4 | |
| The used resin contained 94.0 wt % of components of molecular weights at least 500 | −110 |

What is claimed is:

1. An electrophotographic photosensitive member comprising at least a charge generation layer and a charge transporting layer, characterized in that the charge transport layer comprises a charge-transporting material and a resin which contains at least 95% by weight of components of molecular weights of 500 or higher.

2. The electrophotographic photosensitive member of claim 1, wherein the resin contains, as the monomer component, at least one kind of monomer selected from the group consisting of methacrylic esters, styrene, and a acrylonitrile.

3. The electrophotographic photosensitive member of claim 1, wherein the resin contains, as the monomer component, methyl methacrylate.

4. The electrophotographic photosensitive member of claim 1, wherein the resin contains, as the monomer component, styrene.

5. The electrophotographic photosensitive member of claim 1, wherein the resin is a polyester resin.

6. The electrophotographic photosensitive member of claim 5, wherein the polyester resin is a poly(ethylene terephthalate) resin.

7. The electrophotographic photosensitive member of claim 1, wherein the charge-transporting material is at least one compound selected from the group consisting of polycyclic aromatic compounds and indole, carbazole, oxazole, isoxazole, thiazole, imidazole, oxadiazole, pyrazoline, thiadiazole, triazole, and hydrazone compounds.

8. The electrophotographic photosensitive member of claim 1, wherein the charge-transporting material is a hydrazone compound.

9. The electrophotographic photosensitive member of claim 1, wherein the charge-transporting material is a pyrazoline compound.

10. The electrophotographic photosensitive member of claim 1, wherein the resin is obtained by precipitating in a poor solvent the resin produced by solution polymerization.

11. The electrophotographic photosensitive member of claim 1, wherein the resin is obtained by heating and drying the resin produced by solution polymerization.

12. The electrophotographic photosensitive member of claim 11, wherein the heating and drying is carried out in vacuo.

13. The electrophotographic photosensitive member of claim 1, wherein the charge transport layer is composed of a charge-transporting material and a resin containing at least 97% by weight of components of molecular weights of 500 or higher.

* * * * *

UNITED STATES PATENT AND TRADEMARK OFFICE

CERTIFICATE OF CORRECTION

PATENT NO. : 4,632,892

DATED : December 30, 1987

INVENTOR(S) : YUICHI YASHIKI, ET AL.

It is certified that error appears in the above-identified patent and that said Letters Patent is hereby corrected as shown below:

COLUMN 1

Lines 60-61, "pre-/vented" should read --free--.

COLUMN 2

Line 29, "specially" should read --especially--.

COLUMN 3

Line 20, "racial-polymerized" should read --radical-polymerized--.
Line 36, "specially" should read --especially--.
Line 59, "resins" should read --resin--.

COLUMN 6

Line 5, "coating Mayer" should read --coating, Meyer--.

COLUMN 9

Line 9, "an urethane rubber" should read --a urethane rubber cleaning blade--.
Line 10, "gw/cm," should read --gm/cm,--.

COLUMN 11

Line 25, "dired" should read --dried--.
Line 29, "representd" should read --represented--.
Line 44, "pohtosensi-" should read --photosensi- --.

UNITED STATES PATENT AND TRADEMARK OFFICE

CERTIFICATE OF CORRECTION

PATENT NO. : 4,632,892

DATED : December 30, 1987

INVENTOR(S) : YUICHI YASHIKI, ET AL.

It is certified that error appears in the above-identified patent and that said Letters Patent is hereby corrected as shown below:

COLUMN 13

Line 3, "a acrylonitrile." should read --acrylonitrile.--.

Signed and Sealed this

Eighteenth Day of August, 1987

*Attest:*

*Attesting Officer*

DONALD J. QUIGG

*Commissioner of Patents and Trademarks*